US010262604B2

(12) United States Patent
Kuwajima et al.

(10) Patent No.: US 10,262,604 B2
(45) Date of Patent: Apr. 16, 2019

(54) CONTROL DEVICE, DISPLAY DEVICE, AND CONTROL METHOD FOR DISPLAY DEVICE

(71) Applicant: Sharp Kabushiki Kaisha, Sakai, Osaka (JP)

(72) Inventors: Hidenori Kuwajima, Sakai (JP); Junki Asai, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/529,525

(22) PCT Filed: Dec. 3, 2015

(86) PCT No.: PCT/JP2015/083967
§ 371 (c)(1),
(2) Date: May 25, 2017

(87) PCT Pub. No.: WO2016/093138
PCT Pub. Date: Jun. 16, 2016

(65) Prior Publication Data

US 2017/0316749 A1 Nov. 2, 2017

(30) Foreign Application Priority Data

Dec. 8, 2014 (JP) ..... 2014-248324

(51) Int. Cl.
*G09G 3/36* (2006.01)

(52) U.S. Cl.
CPC ..... *G09G 3/3607* (2013.01); *G09G 3/3611* (2013.01); *G09G 3/3614* (2013.01); *G09G 3/3618* (2013.01); *G09G 3/3648* (2013.01); *G09G 2320/0247* (2013.01); *G09G 2320/0252* (2013.01); *G09G 2340/0435* (2013.01); *G09G 2360/16* (2013.01)

(58) Field of Classification Search
CPC .. G09G 3/3607; G09G 3/3614; G09G 3/3618; G09G 3/3648; G09G 3/3611; G09G 2360/16; G09G 2340/0435; G09G 2320/0247; G09G 2320/0252
See application file for complete search history.

(56) References Cited

U.S. PATENT DOCUMENTS

2008/0001889 A1* 1/2008 Chun ..... G09G 3/2011 345/96
2009/0251445 A1 10/2009 Ito et al.
(Continued)

FOREIGN PATENT DOCUMENTS

JP 2009-251607 A 10/2009
WO 2014/171323 A1 10/2014

OTHER PUBLICATIONS

Official Communication issued in International Patent Application No. PCT/JP2015/083967, dated Feb. 16, 2016.

*Primary Examiner* — Amit Chatly
(74) *Attorney, Agent, or Firm* — Keating & Bennett, LLP

(57) ABSTRACT

A host control section (30) is a control device for a display device (1). The host control section (30) includes an image determining section (35) for calculating a density of pixels, which have intermediate grayscale levels (i.e., grayscale levels of a first range), among a plurality of pixels in an image; and a driving changing section (36) for changing a refresh rate of the display device (1) in accordance with the density which has been calculated.

14 Claims, 11 Drawing Sheets

(56) References Cited

U.S. PATENT DOCUMENTS

| | | | | |
|---|---|---|---|---|
| 2011/0148826 | A1* | 6/2011 | Koyama | G09G 3/3696 345/204 |
| 2016/0086557 | A1* | 3/2016 | Watanabe | G09G 3/3648 345/691 |
| 2016/0093239 | A1* | 3/2016 | Wang | G06F 1/32 345/55 |

* cited by examiner

CONTROL DEVICE, DISPLAY DEVICE, AND CONTROL METHOD FOR DISPLAY DEVICE

TECHNICAL FIELD

The present invention relates to a control device for controlling a display device, the display device, and a method for controlling the display device.

BACKGROUND ART

In recent years, thin, light, and low-power-consumption display devices such as liquid crystal display devices have been remarkably widespread. Typical examples of apparatuses on which such display devices are mounted encompass mobile phones, smartphones, notebook-sized personal computers (PCs), and the like. It is expected that, in the future, development and prevalence of electronic paper, which is an even thinner display device, will be rapidly advanced. Under such circumstances, it is a common challenge to reduce power consumption of display devices.

According to conventional continuous grain (CG) silicon thin film transistor (TFT) liquid crystal display panels, amorphous silicon TFT liquid crystal display panels, and the like, it is necessary to refresh a screen at 60 Hz. Therefore, for a reduction in electronic power consumption of the conventional liquid crystal display panels, attempts have been made to achieve a refresh rate lower than 60 Hz.

In recent years, diligent attempts have been made to develop an oxide semiconductor liquid crystal display panel in which TFTs are each constituted by an oxide semiconductor that uses indium (In), gallium (Ga), and zinc (Zn). According to a TFT constituted by an oxide semiconductor, only a small amount of electric current leaks in an off state. Therefore, unlike the cases of conventional liquid crystal panels, it is unnecessary for an oxide semiconductor liquid crystal display panel to refresh a screen at 60 Hz, and it is therefore possible to lower a refresh rate to approximately 1 Hz. This allows for a reduction in electric power consumption.

CITATION LIST

Patent Literature

[Patent Literature 1]
Japanese Patent Application Publication Tokukai No. 2009-251607 (Publication date: Oct. 29, 2009)

SUMMARY OF INVENTION

Technical Problem

However, in a case where the refresh rate is lowered, flicker may be recognized, and consequently display quality may notably decrease. Here, the flicker means a phenomenon in which one of characteristics such as a luminance and a color of a displayed image periodically varies unfavorably.

With respect to this problem, a driving circuit for a liquid crystal display disclosed in Patent Literature 1 determines whether or not each of frames of received image data has a characteristic of easily causing flicker. Then, in a case where the driving circuit determines that the frame does not have such a characteristic, the driving circuit lowers a refresh rate. Patent Literature 1 exemplifies, as an image having a characteristic of easily causing flicker, (i) an image that is displayed by saturated liquid crystal cells which are adjacent to unsaturated liquid crystal cells and (ii) an image having a stripe pattern extending in a horizontal direction.

However, the driving circuit disclosed in Patent Literature 1 needs to have a configuration to store in advance image patterns having the characteristic of easily causing flicker and to search the image pattern from a frame of received image data.

The present invention is accomplished in view of the problem, and its object is to provide a display device and the like which can easily determine whether or not flicker is easily recognizable in an image.

Solution to Problem

In order to attain the object, the control device in accordance with an aspect of the present invention is a control device for controlling a display device, the control device including: a calculating section for calculating a density of pixels, which have grayscale levels falling within a first range, among a plurality of pixels in an image, grayscale levels in the first range being intermediate grayscale levels; and a driving changing section for changing a refresh rate of the display device in accordance with the density which has been calculated by the calculating section.

Advantageous Effects of Invention

According to an aspect of the present invention, it is possible to bring about an effect of easily determining whether or not flicker is easily recognizable in an image.

DESCRIPTION OF EMBODIMENTS

Figure 1:
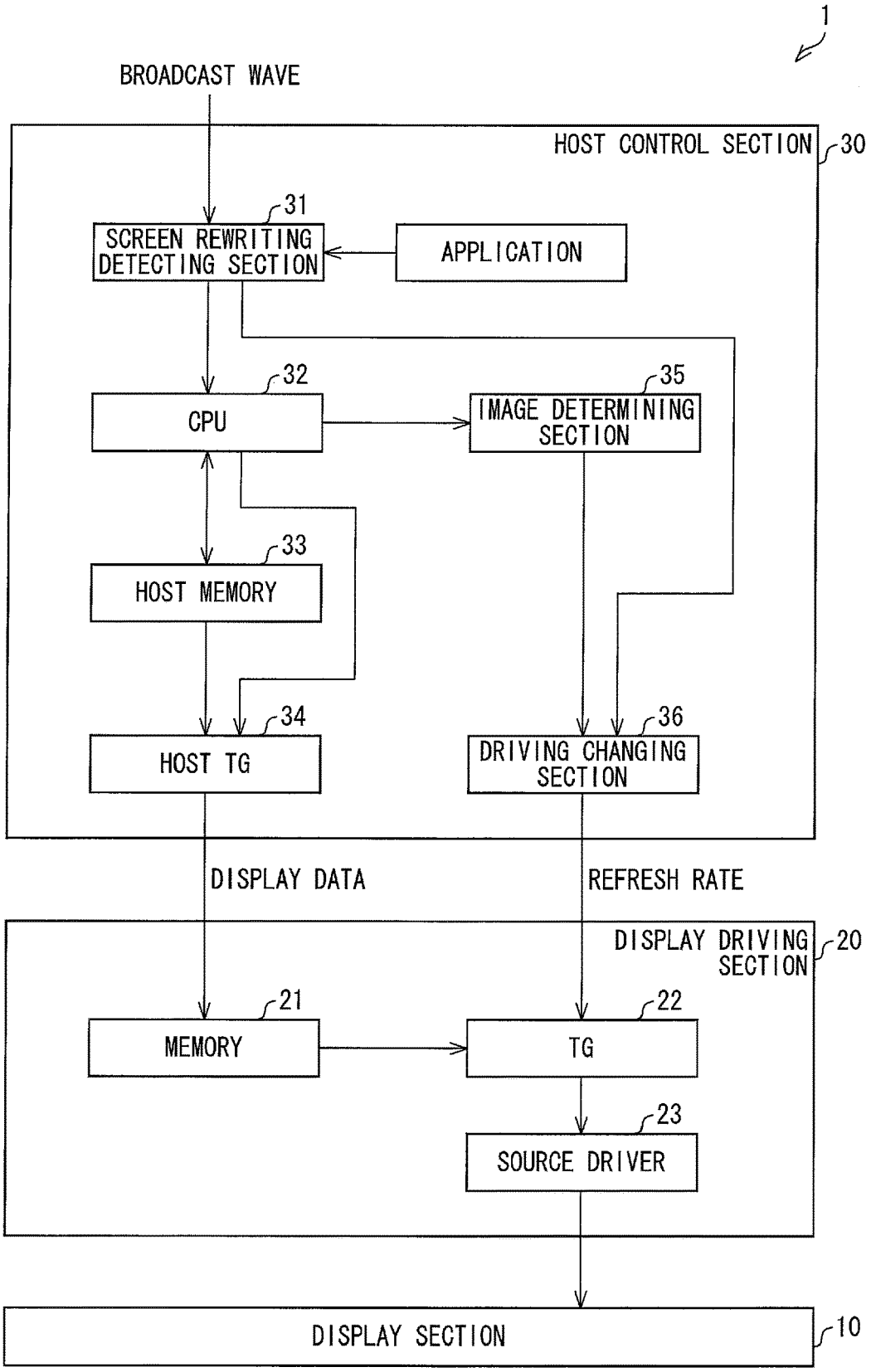
FIG. 1 is a block diagram illustrating a configuration of a display device in accordance with an aspect of the present invention.

The following description will discuss embodiments of the present invention in detail. Note that, for convenience, members having functions identical to those of the respective members described in the embodiments are given respective identical reference numerals, and a description of those members is appropriately omitted.

Embodiment 1

Figure 2:
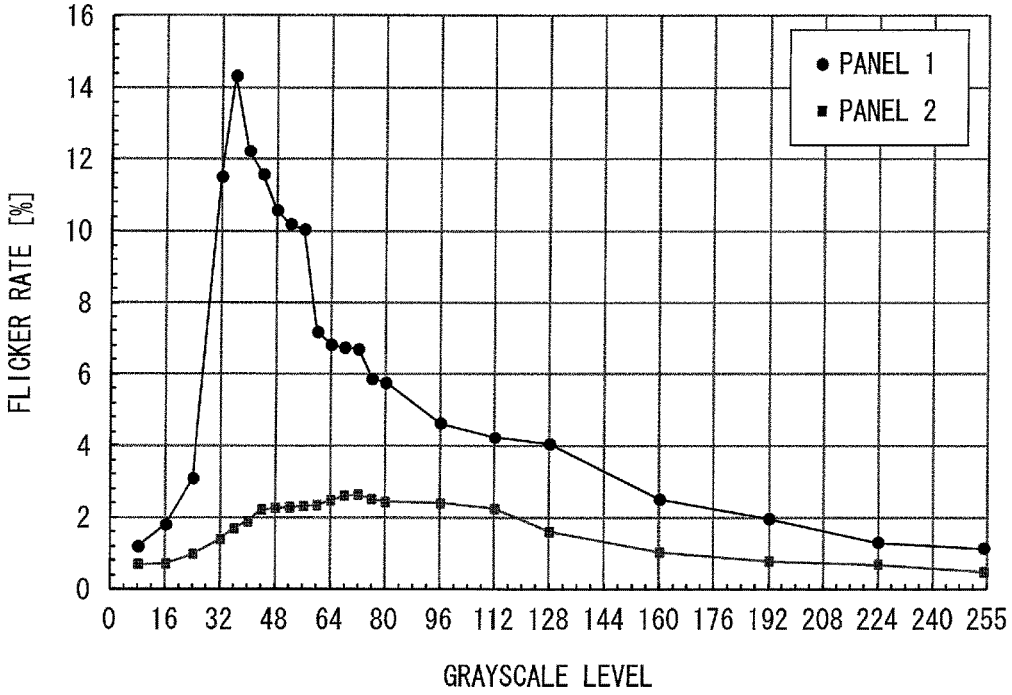
FIG. 2 is a graph showing flicker rates corresponding to respective grayscale levels at which an oxide semiconductor liquid crystal display panel is driven at a refresh rate of 1 Hz.

Before describing an embodiment of the present invention, the following description will discuss grayscale levels at which flicker is easily recognizable. FIG. 2 is a graph showing flicker rates corresponding to respective grayscale levels at which an oxide semiconductor liquid crystal display panel is driven at a refresh rate of 1 Hz.

The flicker rate represents a degree to which flicker is recognizable, and is expressed by the following formula (1):

$$\text{Flicker rate (\%)} = (\text{root mean square (RMS) of } AC \text{ component of luminance})/(DC \text{ component of luminance}) \times 100 \quad (1)$$

A larger value of the flicker rate means greater recognizability of the flicker. For example, a flicker rate of 1.5% is one criterion for determining whether or not flicker is easily recognizable.

In a case where the oxide semiconductor liquid crystal display panel is driven at a low refresh rate, it is a grayscale level of a displayed image that determines whether or not flicker is easily recognizable. In FIG. 2, a minimum grayscale level (black) is 0, and a maximum grayscale level (white) is 255. Moreover, recognizability of flicker also varies depending on a screen size and production process.

A response speed of liquid crystals at intermediate grayscale levels is relatively slow. In addition, at the intermediate grayscale levels, a change in grayscale level (change in orientation of liquid crystal molecules) as a result of leakage of electric charge via TFTs can easily occur. Note that "intermediate grayscale levels" refer to all grayscale levels except for saturated grayscale levels (i.e., maximum grayscale level and the minimum grayscale level). For example, where the minimum grayscale level and the maximum grayscale level are 0 and 255, respectively, grayscale levels falling within a range of grayscale level 1 to grayscale level 254 are intermediate grayscale levels. In a case of a normally-black type, flicker is more easily recognizable in a range of, for example, grayscale level 10 to grayscale level 200 of all the intermediate grayscale levels. Furthermore, flicker is even more easily recognizable in a range of grayscale level 20 to grayscale level 80, and is particularly easily recognizable in a range of grayscale level 40 to grayscale level 60. For example, in a case where an image including a large number of pixels having grayscale levels of the above described ranges is displayed at a refresh rate of 1 Hz, a screen is refreshed every second. This may cause a user to recognize flicker every second.

Meanwhile, even in an image including a large number of pixels having grayscale levels of the above described ranges, flicker is less likely to be recognized if the pixels are dispersed but flicker is more likely to be recognized if the pixels are gathering.

Therefore, according to Embodiment 1, recognition of flicker is prevented by driving a display device at an increased refresh rate in a case where a calculated density, which is indicative of a degree to which pixels having grayscale levels falling within the above described range are gathering in an image, is equal to or higher than a predetermined first threshold value.

(Configuration of Display Device 1)

FIG. 1 is a block diagram illustrating a configuration of a display device in accordance with an embodiment of the present invention. A display device 1 includes a display section 10, a display driving section 20, and a host control section 30 (control device).

(Configuration of Display Section 10)

The display section 10 includes a screen, and is constituted by, for example, an oxide semiconductor liquid crystal display panel serving as an active matrix liquid crystal display panel (liquid crystal display device). The oxide semiconductor liquid crystal display panel is a liquid crystal display panel in which the above-described oxide semiconductor-TFT is used as each switching element provided so as to correspond to one or more of a plurality of pixels that are two dimensionally arranged. The oxide semiconductor-TFT is a TFT having a semiconductor layer made of an oxide semiconductor. Examples of the oxide semiconductor encompass an oxide semiconductor (InGaZnO-based oxide semiconductor) in which an oxide of indium, gallium, and zinc is used. According to the oxide semiconductor-TFT, (i) an amount of electric current flowing in an on state is large and (ii) an amount of leak current in an off state is small. Therefore, by using the oxide semiconductor-TFT for a switching element, it is possible to increase a pixel aperture ratio and to reduce a refresh rate of image display to approximately 1 Hz. Reducing the refresh rate allows for such an effect as a reduction in electric power consumption. An increase in a pixel aperture ratio brings about such an effect as causing a displayed image to be brighter. In a case where the brightness of image display is to be set equal to that of a CG silicon liquid crystal display panel or the like, an increased pixel aperture ratio brings about such an effect as reducing electric power consumption by decreasing a light intensity of a backlight. Note also that the present invention is not limited to a display device using an oxide semiconductor-TFT, but is applicable to any display device capable of changing a refresh rate.

(Configuration of Host Control Section 30)

The host control section 30 includes a screen rewriting detection section 31 (rewriting detection section), a central processing unit (CPU) 32, a host memory 33, a host timing generator (host TG) 34, an image determining section 35 (calculating section), and a driving changing section 36. The host control section 30 is configured by, for example, a control circuit provided on a substrate.

The screen rewriting detection section 31 detects whether or not an image displayed on the screen of the display section 10 needs to be rewritten. For example, the screen rewriting detection section 31 notifies the CPU 32 of necessity to rewrite displaying (image) of the screen in cases such as (i) a case where an application, which was launched and is being run within the display device 1, notifies the screen rewriting detection section 31 that a displayed image needs be rewritten, (ii) a case where a user of the display device 1 notifies, via an input section, the screen rewriting detection section 31 that a displayed image needs to be rewritten, and (iii) a case where the screen rewriting detection section 31 is notified of the necessity to rewrite a displayed image due to data streaming via the Internet, a broadcast wave, or the like.

In Embodiment 1, display data inputted in the screen rewriting detection section 31 includes (i) a displayed image to be rewritten in a frame and (ii) a display rewriting flag (time reference) indicative of a timing at which the image data is displayed. In a case where content of an image is not changed over a plurality of frames, data in frames in which the content of the image is not changed is not included in the display data. Based on the display rewriting flag, the screen rewriting detection section 31 can detect the necessity to rewrite a displayed image. The screen rewriting detection section 31 stores time of a frame at which the content of the image was changed. Then, based on the display rewriting flag, the screen rewriting detection section 31 detects an interval between (i) a given frame in which the content of the image was changed (i.e., frame in which the displayed image was rewritten) and (ii) a following frame in which the content of the image was changed next. Based on the interval, it is possible to determine whether the displayed image is a moving image or a still image. The screen rewriting detection section 31 supplies the display rewriting flag and the display data to the CPU 32. In addition, the screen rewriting detection section 31 supplies, to the driving changing section 36, data on the interval at which the content of the image is changed.

Note that in a case where the display data does not include a display rewriting flag but includes data on all frames, the screen rewriting detection section 31 can determine, by comparing an image in a given frame and an image in a following frame, whether or not content of the image is changed. Based on a result of the comparison, the screen rewriting detection section 31 can detect necessity to rewrite a displayed image. In such a case also, the screen rewriting detection section 31 evaluates, based on time of frame at which the displayed image is rewritten, an interval between (i) a frame in which the content of the image was changed and (ii) a following frame in which the content of the image was changed next.

The CPU 32 (i) obtains, from the screen rewriting detection section 31, the display data of one entire screen and then (ii) writes the display data into the host memory 33. The CPU 32 also supplies the display data to the image determining section 35. The CPU 32 also supplies the display rewriting flag to the host TG 34.

The host memory 33 is a storage device configured by a video random access memory (VRAM) or the like.

When the host TG 34 has received the display rewriting flag from the CPU 32, the host TG 34 (i) obtains the display data from the host memory 33 and (ii) transfers the display data to the display driving section 20. Only in a case where a displayed image needs to be rewritten, the host TG 34 transfers, to the display driving section 20, display data on the image to be rewritten in a frame. The host TG 34 transfers the display data in accordance with data communication specifications of a mobile device, such as a mobile industry processor interface (MIPI). Note that the host TG 34 transfers, to the display driving section 20, a sync signal along with the display data.

The image determining section 35 determines whether or not an image indicated by the display data is an image in which flicker easily occurs. The image determining section 35 supplies a determined result to the driving changing section 36.

Specifically, the image determining section 35 determines whether or not pixels in the image have grayscale levels falling within a predetermined first range (e.g., grayscale level 20 to grayscale level 80). The image determining section 35 calculates a density indicative of a degree to which pixels having grayscale levels falling within the first range are gathering in the image. Note that details of the density will be described later.

Next, the image determining section 35 determines whether or not the density which has been calculated is equal to or higher than a predetermined first threshold value. In a case where the density is equal to or higher than the first threshold value, the image determining section 35 determines that flicker easily occurs in the image. In a case where the density is lower than the first threshold value, the image determining section 35 determines that flicker does not easily occur in the image. Note that values within the first range are illustrative only, and can be other values. The first threshold value and the like are set as appropriate depending on a displaying method, a display driving method, a screen size, and the like.

Based on the determined result of the image determining section 35, the driving changing section 36 changes (determines) the refresh rate of the display section 10. The driving changing section 36 instructs the display driving section 20 to drive the display section 10 at a refresh rate thus changed.

Specifically, in a case where (i) the displayed image is a still image and (ii) the density of pixels having grayscale levels within the first range is lower than the first threshold value, the driving changing section 36 determines that the display section 10 displays the image at a first refresh rate (1 Hz). In a case where (i) the displayed image is a still image and (ii) the density of pixels having grayscale levels within the first range is equal to or higher than the first threshold value, the driving changing section 36 determines that the display section 10 displays the image at a second refresh rate (60 Hz) which is higher than the first refresh rate.

Note, however, that in a case where the displayed image is a moving image, the driving changing section 36 determines that the display section 10 displays the image at a third refresh rate (30 Hz) which falls between the first refresh rate and the second refresh rate. In a case where the displayed image is a moving image, the content of the image is changed at short intervals. This causes flicker to be hardly recognizable even in a case where the density of pixels having grayscale levels within the first range is high. Therefore, in a case where, for example, a moving image is rewritten at a frequency of 30 Hz, the moving image can be refreshed at 30 Hz and it is unnecessary to refresh the moving image at 60 Hz which is higher than 30 Hz. In a case where, for example, a moving image is rewritten at a frequency of 15 Hz, it is possible to refresh the moving image at 15 Hz or 30 Hz. Note that the driving changing section 36 can determine, based on intervals at which the content of the image is changed, whether the displayed image is a moving image or a still image.

(Configuration of Display Driving Section 20)

The display driving section 20 is, for example, a so-called chip-on-glass (COG) driver and is mounted on a glass substrate of the display section 10 by use of a COG technique. The display driving section 20 drives the display section 10 to cause a screen of the display section 10 to display an image based on display data. The display driving section 20 includes a memory 21, a timing generator (TG) 22, and a source driver 23.

The memory 21 stores the display data transferred from the host control section 30. The memory 21 then retains the display data until the displayed image is rewritten next (i.e. retains the display data unless the content of the image is changed).

Based on the refresh rate instructed by the host control section 30, the TG 22 reads out the display data from the memory 21, and supplies the display data to the source driver 23. In addition, the TG 22 generates a timing signal for driving the display section 10 at the refresh rate thus instructed, and supplies the timing signal to the source driver 23. Note that, for generating the timing signal, the TG 22 can utilize the sync signal supplied from the host TG.

In accordance with the timing signal, the source driver 23 writes, into the pixels of the display section 10, respective display voltages corresponding to the display data.

Suitable examples of the display device 1 encompass display devices that place importance particularly on portability, such as mobile phones, smartphones, notebook-sized PCs, tablet devices, e-book readers, and personal digital assistants (PDAs).

(Display Driving Method)

Figure 3:
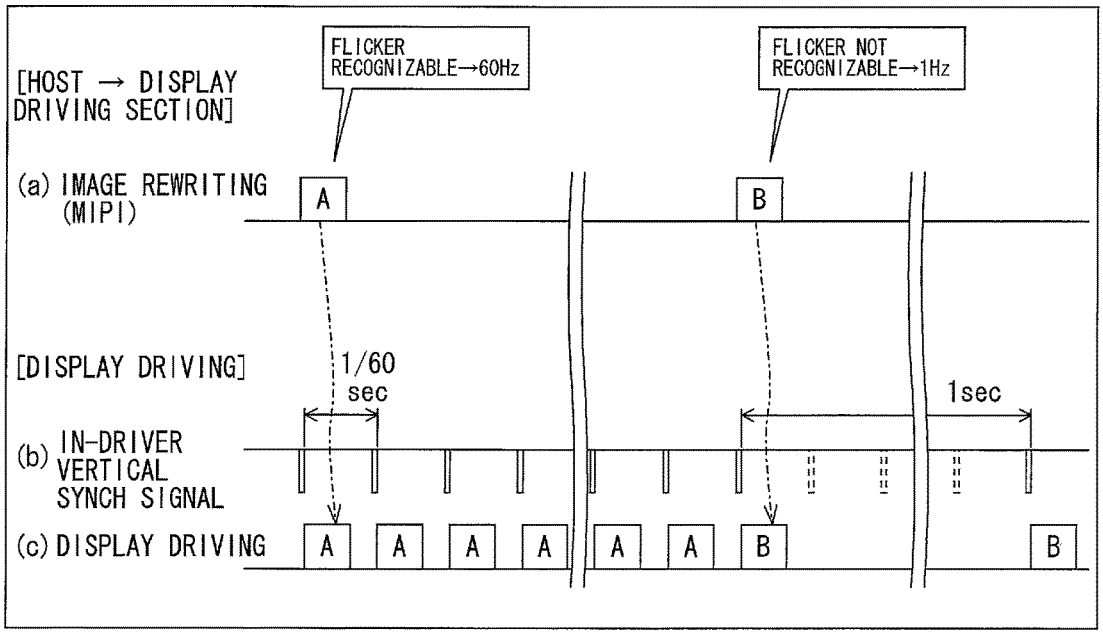
FIG. 3 is a timing chart showing how the display device displays a still image.

FIG. 3 is a timing chart showing how the display device 1 displays a still image. FIG. 3 illustrates a case where a still image A and a still image B are sequentially displayed. The image A is an image in which flicker easily occurs. The image B is an image in which flicker hardly occurs. Therefore, the image A is displayed at a refresh rate of 60 Hz, whereas the image B is displayed at a refresh rate of 1 Hz.

The host control section 30 transfers display data (image A or image B) on one entire screen to the display driving section 20 only when content of a screen is changed (see (a) of FIG. 3). After the display data on the image A is transferred, it is when the displayed image is rewritten to the image B that the host control section 30 transfers display data to the display driving section 20 next.

The display driving section 20 (i) causes the memory 21 to store the received display data (image A) and (ii) rewrites, at a timing synchronized with an in-driver vertical sync signal illustrated in (b) of FIG. 3, the displayed image on the display section 10 to the image A (see (c) of FIG. 3). The in-driver vertical sync signal is generated by the TG 22 in accordance with an instructed refresh rate. Note that a delay time between a point in time where the display driving section 20 receives the display data and a point in time where the image is displayed is omitted in FIG. 3.

Then, the image A thus displayed is refreshed every 1/60 seconds. Specifically, the display driving section 20 operates such that the TG 22 reads out display data (image A) from the memory 21 every 1/60 seconds, and then the source driver 23 supplies the display data to the display section 10.

After the image B is displayed on the display section 10, on the other hand, the image B thus displayed is refreshed every second. Specifically, the display driving section 20 operates such that the TG 22 reads out display data (image B) from the memory 21 every second, and then the source driver 23 supplies the display data to the display section 10. In so doing, an in-driver vertical sync signal is also generated along with the refresh rate of 1 Hz. Note that a pulse shown by dotted lines in (b) of FIG. 3 indicates a pulse which would be generated if the refresh rate was 60 Hz but was actually not generated because the refresh rate is 1 Hz.

Figure 4:
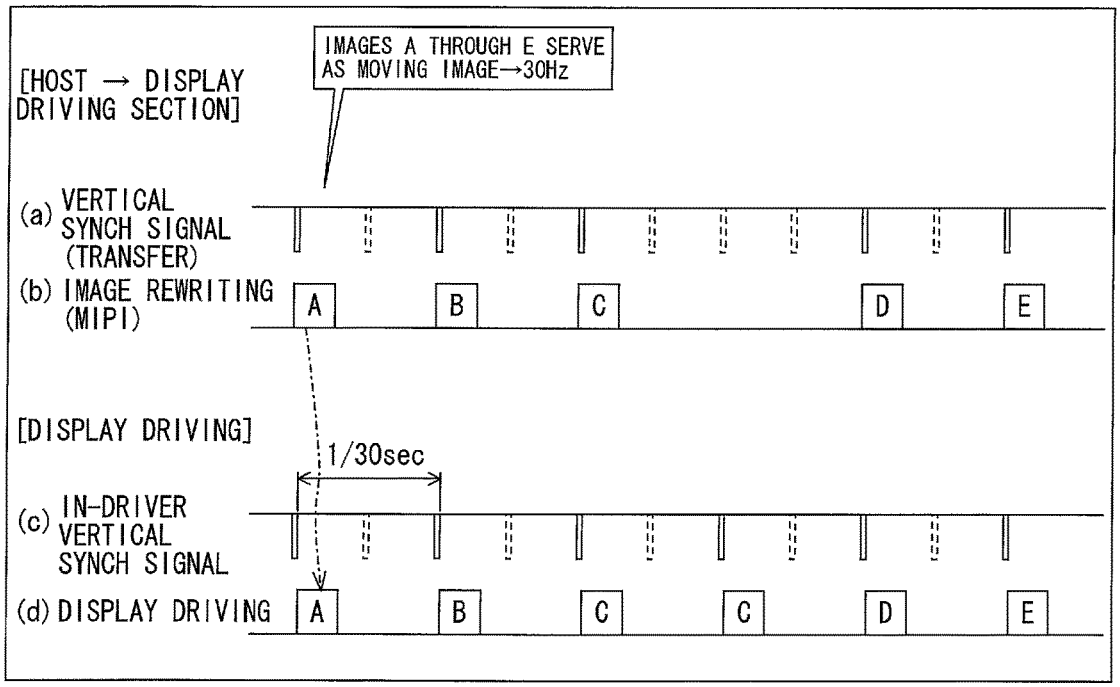
FIG. 4 is a timing chart showing how the display device displays a moving image.

FIG. 4 is a timing chart showing how the display device 1 displays a moving image. FIG. 4 illustrates a case where images A through E, which serve as a moving image, are displayed in turn. The images A, B, D, and E are each displayed for 1/30 seconds, whereas the image C is displayed for 1/15 seconds. Intervals, at which content of the moving images is changed from one image to another, are each equal to or shorter than an interval threshold value (e.g. 400 ms) in all the images A through E. Therefore, since the images A through E are regarded as a moving image, the images A through E are displayed at a refresh rate of 30 Hz regardless of grayscale levels of the images A through E.

Only when the content of an image is changed, the host control section 30 transfers, at a timing synchronized with a vertical sync signal (transfer), display data (images A through E) of one entire screen to the display driving section 20 (see (a) and (b) of FIG. 4). Note that a pulse shown by dotted lines in (a) of FIG. 4 indicates a pulse which would be generated if the content of the image was changed every 1/60 seconds but was actually not generated because the content of the image is not changed.

The display driving section 20 (i) causes the memory 21 to store the received display data (image A) and (ii) rewrites, at a timing synchronized with an in-driver vertical sync signal illustrated in (c) of FIG. 4, the displayed image on the display section 10 to the image A (see (d) of FIG. 4). The in-driver vertical sync signal is generated by the TG 22 in accordance with an instructed refresh rate.

In a case where, as is the case of the image C, intervals at which content of an image is changed are each longer than each of intervals at which an image is refreshed (1/30 seconds), the display driving section 20 operates such that display data (image C) stored in the memory 21 is read out by the TG 22 every 1/30 seconds, and then the source driver 23 supplies the display data to the display section 10. Note that a pulse shown by dotted lines in (c) of FIG. 4 indicates a pulse which would be generated if the refresh rate was 60 Hz but was actually not generated because the refresh rate is 30 Hz.

(Details of Density)

The following description will discuss details of the density. As above described, the density of pixels having grayscale levels falling within the first range represents a degree to which the pixels are gathering in an image. With regard to the gathering of the pixels, the following properties (a) and (b) can be assumed.

(a) Even in a case where target pixels are discontinuous, the target pixels which are included, with a predetermined percentage or higher, in a region having a predetermined size are considered as gathering.

(b) Among regions each of which includes target pixels with the predetermined percentage or higher, target pixels in a larger region are considered as further gathering, as compared with target pixels in a smaller region.

Based on the properties (a) and (b), the density of the pixels is calculated as follows in Embodiment 1. That is, among pixels included in a predetermined pattern in the image, in a case where a percentage of pixels having grayscale levels falling within the first range is equal to or more than the predetermined percentage, the density is incremented, and this process is repeated for the entire region of the image while moving the predetermined pattern by a predetermined distance in a row direction and a column direction in the image. Thus, the density is calculated.

Note that the predetermined size is preferably not smaller than a certain size (e.g., 1 $cm^2$). This is because, in a case where the predetermined size is small, flicker is hardly recognizable even if a percentage of such pixels is high in a certain region having the predetermined size, provided that a percentage of such pixels in a region adjacent to the certain region is low. For a similar reason, the predetermined pattern preferably has a size which is not smaller than a certain length (e.g., 1 cm) in a transverse direction or a longitudinal direction. The predetermined percentage is, for example, 80%, and can be determined as appropriate in accordance with a displaying method, a display driving method, a screen size, and the like.

Figure 5:
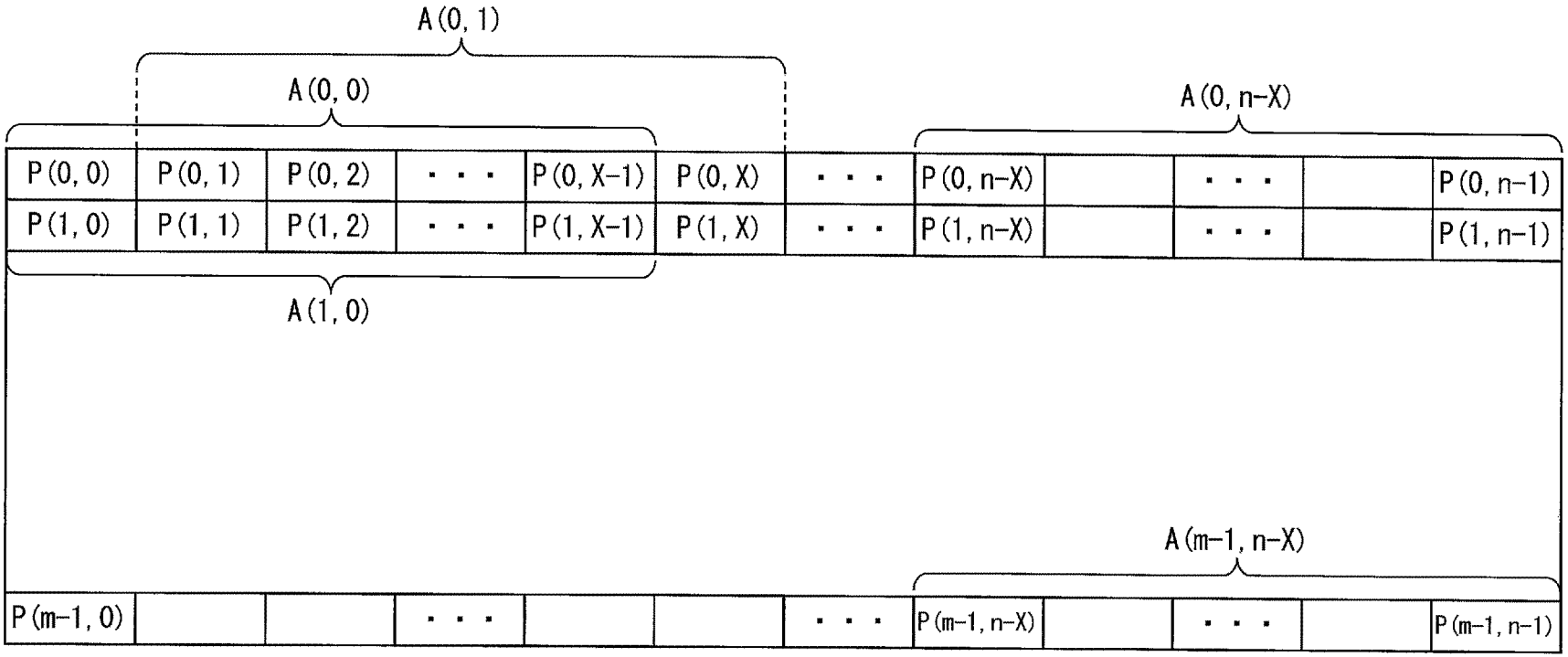
FIG. 5 is a view illustrating pixels included in an image displayed by the display device.

FIG. 5 is a view showing pixels P(0,0) through P(m−1, n−1) included in an image, and is an image for concretely explaining a method for calculating the density. In the example shown in FIG. 5, the image has pixels arranged in a matrix of m rows×n columns. In general, display data is sequentially supplied to pixels P(0,0) through P(0,n−1) in the first row, and then sequentially supplied to pixels P(0,0) through P(0,n−1) in the second row, and this is subsequently repeated until the display data is ultimately sequentially supplied to pixels P(m−1,0) through P(m−1,n−1) in an m-th row. Note that m is an integer of 2 or more, and n is an integer of 3 or more.

In Embodiment 1, the predetermined pattern of the image shown in FIG. 5 is a rectangular pattern including pixels arranged in a matrix of 1 row×a plurality of columns (X columns). In this case, X is an integer of 2 or more and less than n (2≤X<n).

First, the predetermined pattern is arranged so that an upper left corner of the predetermined pattern conforms to a pixel P(0,0) at an upper left corner. Next, pixels Pf having grayscale levels falling within the first range are counted in a region A(0,0) including pixels P(0,0) through P(0,X−1) in the arranged predetermined pattern, and it is determined whether or not the number of the pixels Pf is equal to or larger than a predetermined number. Note that the predetermined number is obtained by "predetermined percentage× X". In a case where the number of the pixels Pf is equal to or more than the predetermined number, the density Dc is incremented by 1. Note that the increment can be 2 or more.

Next, the predetermined pattern is moved in a rightward direction by 1 pixel, and a similar process is carried out. That is, in a case where the number of the pixels Pf in a region A(0,1) including pixels P(0,1) through P(0,X) in the moved predetermined pattern is counted and the number of the pixels Pf is equal to or more than the predetermined number, the density Dc is incremented by 1. Subsequently, this process is repeated until a right end of the predetermined pattern reaches a pixel P(0,n−1) at a right end.

Next, the predetermined pattern is arranged so that the upper left corner of the predetermined pattern conforms to a pixel P(1,0) which is below the pixel P(0,0) at the upper left corner by 1 pixel in a downward direction, and a similar process is repeated. Then, the process is repeated until a lower right corner of the predetermined pattern reaches a pixel P(m−1,n−1) at a lower right corner. As a result, it is possible to calculate the density Dc in relation to the entire image.

Note that the amount by which the predetermined pattern is moved is preferably 1 pixel to several pixels, and only needs to be less than X pixels. That is, it is only necessary that pixels in the predetermined pattern before being moved partially overlap with pixels in the predetermined pattern after being moved.

(Flow of Process of Determining Refresh Rate)

Figure 6:
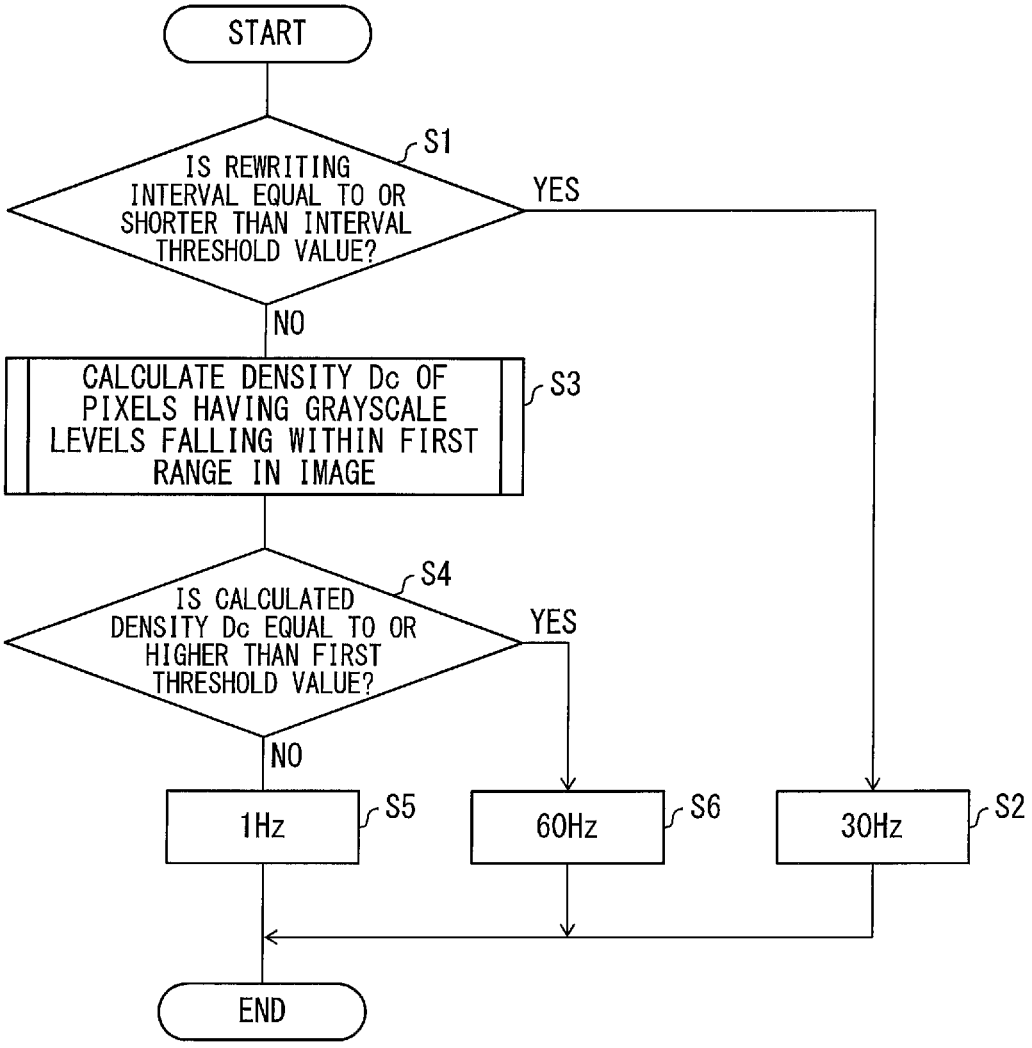
FIG. 6 is a view showing a flow chart of a process in which a host control section of the display device determines a refresh rate.

FIG. 6 is a view showing a flow chart of a process in which the host control section 30 determines a refresh rate. The flow shown in FIG. 6 is carried out each time the screen rewriting detection section 31 detects rewriting of a displayed image (i.e. detects a change in content of the image).

When the screen rewriting detection section 31 detects, based on a display rewriting flag or the like, a change in content of an image, the screen rewriting detection section 31 evaluates an interval between points in time at which the content of the image is changed. Then, the driving changing section 36 determines whether or not the interval (rewriting interval) is equal to or shorter than a predetermined interval threshold value (e.g. 400 ms) (S1).

In a case where the interval between points in time at which the content of the image is changed is equal to or shorter than the interval threshold value (Yes in S1), the driving changing section 36 determines that a displayed image is a moving image, and therefore sets a refresh rate to 30 Hz (S2).

In a case where the interval between points in time at which the content of the image is changed is longer than the interval threshold value (No in S1), the driving changing section 36 determines that the displayed image is a still image. Then, the image determining section 35 calculates a density of pixels in the image which pixels have grayscale levels falling within a first range (i.e., a range of grayscale level 20 to grayscale level 80) (S3, calculating step).

Figure 7:
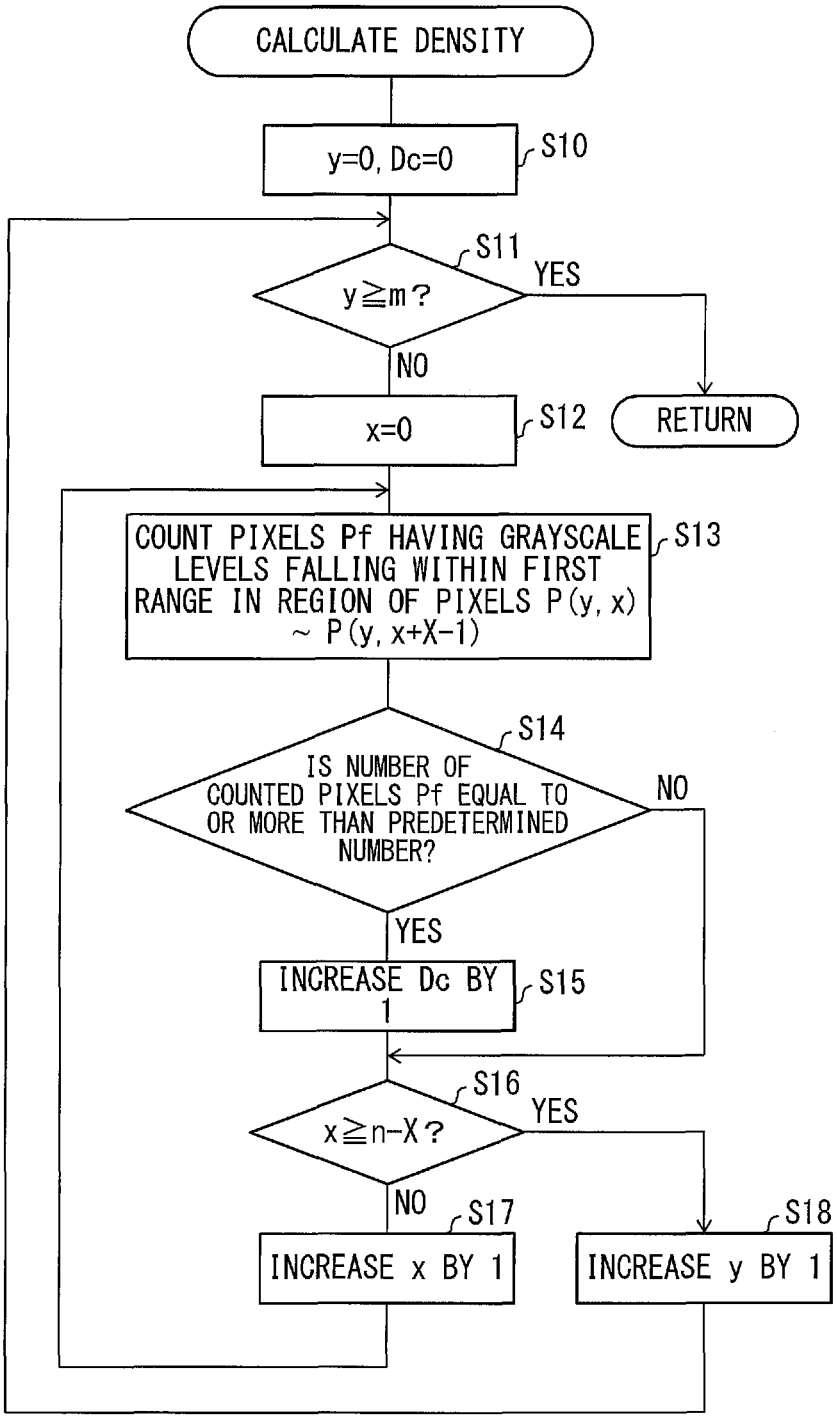
FIG. 7 is a view showing a flow chart of a process in which the host control section calculates a density.

FIG. 7 is a flow chart of a subroutine for calculating the density. First, a y-th row is initialized to zero, and the density Dc is initialized to zero (S10).

Next, it is determined whether or not y m, that is, whether or not the process has been repeated for all regions A(0,0) through A(m−1,n-X) in the image (S11). In a case where y≥m (Yes in S11), the subroutine is ended and the process returns to the original process shown in FIG. 6.

On the other hand, in a case where y<m (No in S11), an x-th column is initialized to zero (S12), and the number of pixels Pf having grayscale levels falling within the first range are counted in a region A(y,x) including pixels P(y,x) through P(y,x+X−1) in the y-th row (S13). Next, it is determined whether or not the number of counted pixels Pf is equal to or more than the predetermined number (S14) and, in a case where the counted number is equal to or more than the predetermined number, the density Dc is incremented by 1 (S15).

Next, it is determined whether or not x≥n-X, that is, whether or not the process has been repeated for all regions A(y,0) through A(y,n-X) in a y-th column (S16). In a case where x<n-X (No in S16), x is incremented by 1 (S17), the process returns to the step S13, and the above process is repeated. On the other hand, in a case where x≥n-X (Yes in S16), y is incremented by 1 (S18), the process returns to the step S11, and the above process is repeated.

After the processes shown in FIG. 7, the image determining section 35 determines whether or not the calculated density is equal to or higher than a first threshold value (S4).

In a case where the interval between points in time at which the content of the image is changed is longer than the interval threshold value and the density of pixels having grayscale levels falling within the first range is lower than the first threshold value (No in S4), the driving changing section 36 set the refresh rate to 1 Hz (S5, driving changing step).

In a case where the interval between points in time at which the content of the image is changed is longer than the interval threshold value and the density of pixels having grayscale levels falling within the first range is equal to or higher than the first threshold value (Yes in S4), the driving changing section 36 sets the refresh rate to 60 Hz (S6, driving changing step).

(Effect of Display Device 1)

According to the display device 1 in accordance with Embodiment 1, it is possible to determine whether or not flicker is easily recognizable in an image, by calculating a density Dc of pixels having grayscale levels falling within the first range in the image. From this, it is unnecessary to use an image pattern having a characteristic of easily causing flicker, and it is therefore possible to easily determine whether or not flicker is easily recognizable in an image.

Moreover, according to the display device 1 of Embodiment 1, a refresh rate is set to a high value in a case where a still image to be displayed is an image in which flicker is easily recognizable. This prevents flicker from being recognized. In a case where a still image to be displayed is an image in which flicker is hardly recognizable, the refresh rate is set to a low value. This allows a reduction in electric power consumption. Therefore, with the display device 1, it is possible to reduce electric power consumption while maintaining high display quality.

In a case where a moving image is to be displayed, flicker is hardly recognizable, regardless of grayscale levels of pixels. In a case where a moving image is displayed, the display device 1 sets the refresh rate to a moderate level. This restricts excessive refreshing, and therefore allows for a reduction in electric power consumption. In so doing, the refresh rate only needs to be at least equal to or higher than a frequency at which the moving image is rewritten.

Alternatively, the display device 1 can be configured such that, regardless of whether a moving image or a still image is displayed, a refresh rate is determined according to a percentage of pixels, of all pixels included in the image, which have grayscale levels falling within a first range. For example, it is possible to set a high refresh rate and a low refresh rate to 60 Hz and 15 Hz, respectively.

According to the display device 1, the display driving section 20 refreshes an image during a period in which the image is not changed. This makes it unnecessary for the host control section 30 to transfer an image to the display driving section 20, and therefore allows the host control section 30 to pause its operation during the period in which the image is not changed. A significant effect of reducing electric power consumption can be obtained as a result of the host control section 30 pausing its operation.

Modification Example 1

In Embodiment 1, as the predetermined pattern, a rectangular pattern is used which includes pixels arranged in a matrix of 1 row×X columns. Note, however, that it is possible to use a rectangular pattern which includes pixels arranged in matrix of a plurality of rows (Y rows)×X columns. In this case, Y is an integer of 2 or more and less than m ($2 \leq y < m$).

In a case where the rectangular pattern including pixels arranged in a matrix of Y rows×X columns is used, there is a possibility that a circuit scale is enlarged, as compared with a case of Embodiment 1 in which the rectangular pattern including pixels arranged in a matrix of 1 row×X columns is used. However, the calculated density can reflect a density of pixels having grayscale levels falling within the first range in the column direction, and it is possible to accurately find an image in which flicker is easily recognizable. As a result, it is possible to more appropriately lower a refresh rate, and it is possible to reduce power consumption while maintaining high display quality.

The predetermined pattern can have any of various shapes (e.g., a circular shape) other than the rectangular shape. Note that the rectangular pattern leads to a simpler circuit configuration, as compared with a pattern having any other one of various shapes.

Modification Example 2

In Embodiment 1, the density Dc for the entire image is calculated, as shown in FIG. 7. In the process shown in FIG. 7, it is possible that the process is halted in a case where the density Dc has become equal to or higher than the first threshold value, and the process returns to the process shown in FIG. 6. In this case, it is possible to omit unnecessary processes, and this leads to lower power consumption.

Modification Example 3

A single picture element includes R, G, and B pixels. In the example above, the image determining section 35 determines the percentage of pixels, of all pixels in an image, which have grayscale levels within the first range, regardless of colors of the pixels (color component: RGB).

Alternatively, the image determining section 35 can determine (i) respective percentages of R, G, and B pixels having grayscale levels within the first range and (ii) determine respective weighted values of the percentages. In such a case, the image determining section 35 determines whether or not a sum of the weighted values is equal to or higher than a predetermined threshold value. Degrees to which an ordinary person can recognize R, G, and B colors are said to be in a ratio of 3:6:1. That is, an ordinary person clearly recognizes G (green) pixels. This means that flicker is more likely to be recognizable if a large number of G pixels have grayscale levels within the first range.

Therefore, the image determining section 35 determines (i) a density Dc(R) of R (red) pixels, of all R pixels in the image, which have grayscale levels within the first range, (ii) a density Dc(G) of G pixels, of all G pixels in the image, which have grayscale levels within the first range, and (iii) a density Dc(B) of B pixels, of all B pixels in the image, which have grayscale levels within the first range. Then, the image determining section 35 determines, as the sum of the weighted values, a value obtained by $(3 \times Dc(R))+(6 \times Dc(G))+(1 \times Dc(B))$. In a case where the sum is equal to or higher than a predetermined threshold value (e.g., a value obtained by (3+6+1)×first threshold value), the image determining section 35 can determine that flicker is easily recognizable in the image.

Alternatively, whether or not flicker is easily recognizable in an image can be determined by the image determining section 35, based on luminances Y of respective picture elements determined from grayscale levels of R, G, and B. Specifically, the image determining section 35 determines the luminances Y of the respective picture elements where, for example, luminance Y=R grayscale×0.29891+G grayscale×0.58661+B grayscale×0.11448. In a case where a luminance Y of a corresponding one of the picture elements falls within a predetermined range (e.g., 20 to 80), the image determining section 35 can determine that pixels included in the picture element have grayscale levels within the first range. That is, in a case where a first threshold value or a higher density Dc of picture elements have luminances Y falling within the predetermined range, the image is displayed at a high refresh rate (60 Hz) so that flicker is prevented from being recognized.

Embodiment 2

The following description will discuss another embodiment of the present invention. In Embodiment 2, a block configuration of a display device is identical with that of Embodiment 1 but a method for driving liquid crystals in the display section 10 and a shape of a predetermined pattern for obtaining a density Dc are different from those of Embodiment 1.

In general, liquid crystal display panels are driven by various polarity reversing methods, in which a polarity of a pixel in a liquid crystal display panel is reversed every frame. The various polarity reversing methods (reversal driving methods) may easily cause flicker of different types of patterns.

In view of this, in Embodiment 2, the density of pixels having the same polarity is calculated. This makes it possible to accurately determine whether or not flicker is easily recognizable in an image. As a result, it is possible to more appropriately lower a refresh rate, and it is possible to further reduce power consumption while maintaining high display quality.

Figure 8:
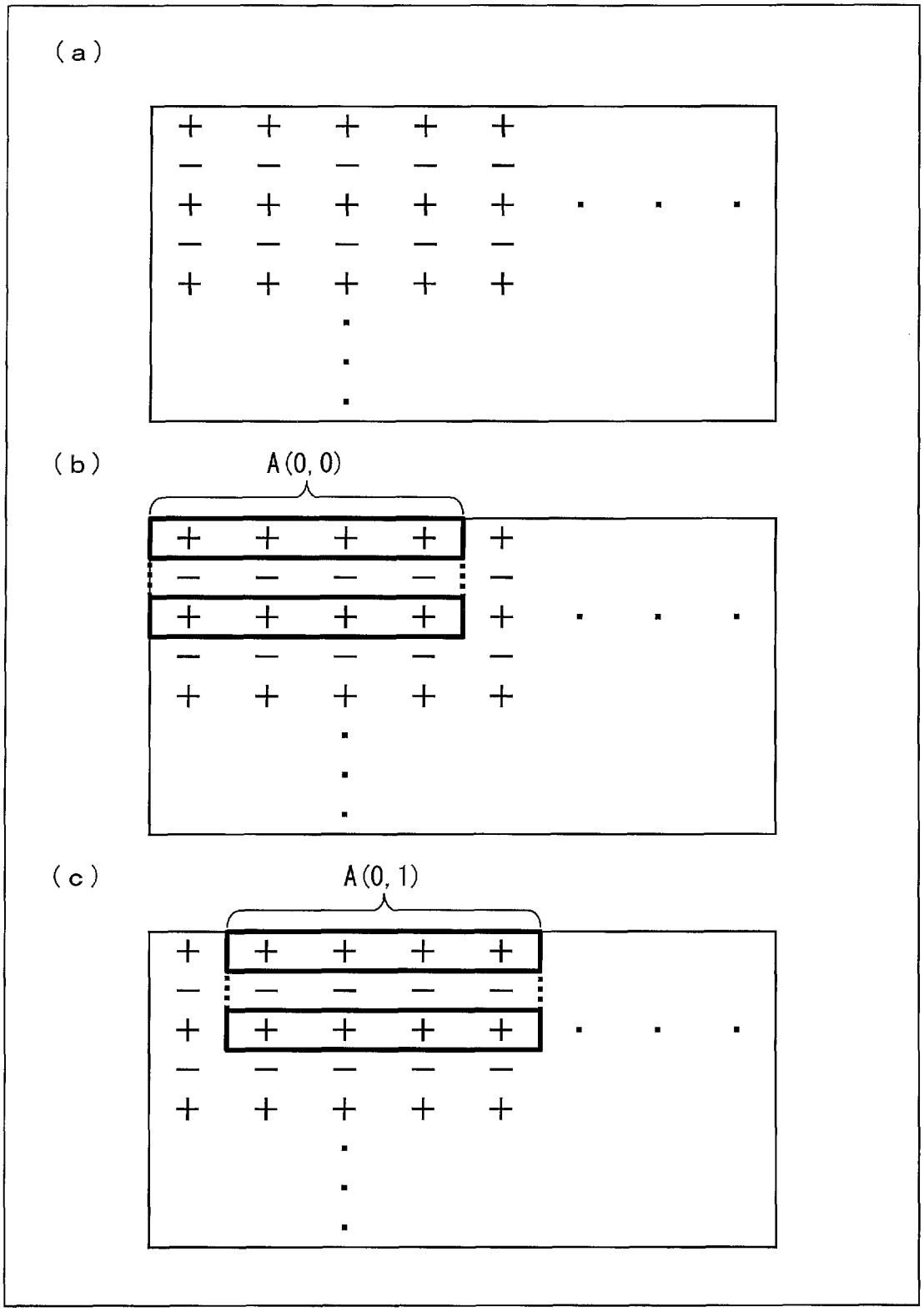
FIG. 8 is a view showing a driving method in the display device and a shape of a predetermined pattern for calculating the density.

FIG. 8 is a view illustrating the driving method and a shape of the predetermined pattern in Embodiment 2. As illustrated in (a) of FIG. 8, in Embodiment 2, pixels in the same row are driven in the same polarity, and the polarity is reversed for each of the rows.

In Embodiment 2, the density Dc is calculated by using, as the predetermined pattern, a pattern including pixels in x-th column through (x+3)th column in y-th row and pixels in x-th column through (x+3)th column in (y+2)th row.

First, as illustrated in (b) of FIG. 8, the predetermined pattern is arranged so that an upper left corner of the predetermined pattern conforms to a pixel P(0,0) at an upper left corner. Next, pixels Pf having grayscale levels falling within the first range are counted in a region A(0,0) including pixels P(0,0) through P(0,4) and pixels P(2,0) through P(2,4) in the arranged predetermined pattern. In a case where the number of the pixels Pf is equal to or larger than a predetermined number, the density Dc is incremented by 1.

Next, as illustrated in (c) of FIG. 8, the predetermined pattern is moved in a rightward direction by 1 pixel, and a similar process is carried out. That is, in a case where the number of the pixels Pf in a region A(0,1) including pixels P(0,1) through P(0,5) and pixels P(2,1) through P(2,5) in the moved predetermined pattern is counted and the number of the pixels Pf is equal to or more than the predetermined number, the density Dc is incremented by 1. Subsequently, this process is repeated until a right end of the predetermined pattern reaches a pixel P(0,n−1) at a right end.

Next, the predetermined pattern is arranged so that the upper left corner of the predetermined pattern conforms to a pixel P(2,0) which is below the pixel P(0,0) at the upper left corner by 2 pixels in a downward direction, and a similar process is repeated. Then, the process is repeated until a lower right corner of the predetermined pattern reaches a pixel P(m−1,n−1) at a lower right corner. As a result, it is possible to calculate a density Dc in relation to the entire image.

Modification Example 1

Figure 9:
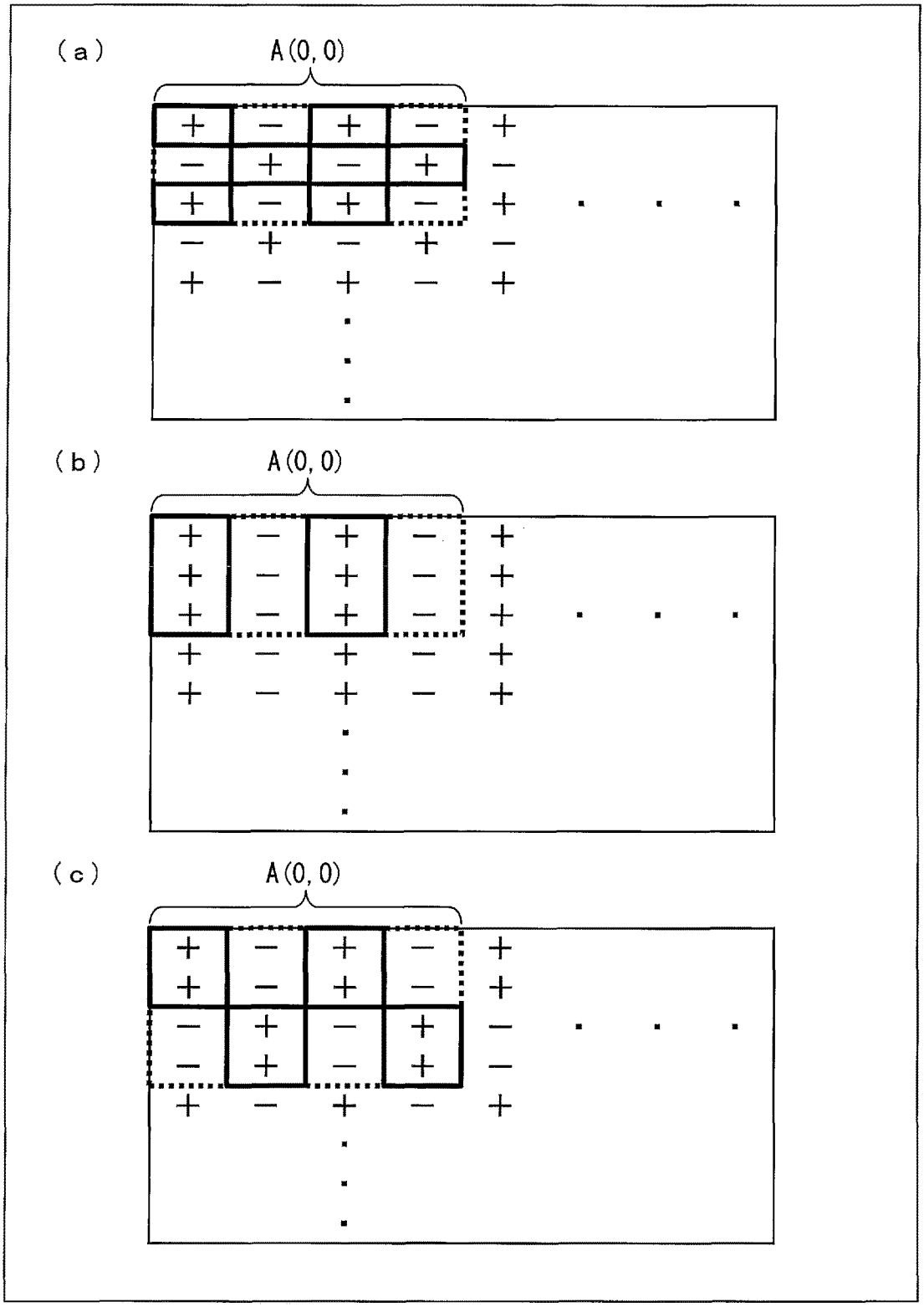
FIG. 9 is a view showing various driving methods in the display device and shapes of the predetermined pattern.

FIG. 9 is a view illustrating the driving method and a shape of the predetermined pattern in various modification examples of Embodiment 2.

In an example illustrated in (a) of FIG. 9, adjacent pixels are driven in different polarities. In Modification Example 1, the density Dc is calculated by using, as the predetermined pattern, a pattern including pixels in x-th column in y-th row; (x+2)th column in y-th row; (x+1)th column in (y+1)th row; (x+3)th column in (y+1)th row; x-th column in (y+2)th row; and (x+2)th column in (y+2)th row.

First, as illustrated in (a) of FIG. 9, the predetermined pattern is arranged so that an upper left corner of the predetermined pattern conforms to a pixel P(0,0) at an upper left corner. Next, pixels Pf having grayscale levels falling within the first range are counted in a region A(0,0) including a pixel P(0,0), a pixel P(2,0), a pixel P(1,1), a pixel P(1,3), a pixel P(0,2), and a pixel P(2,2) in the arranged predetermined pattern. In a case where the number of the pixels Pf is equal to or larger than a predetermined number, the density Dc is incremented by 1.

Next, the predetermined pattern is moved in a rightward direction by 2 pixels, and a similar process is carried out. Subsequently, this process is repeated until a right end of the predetermined pattern reaches a pixel P(0,n−1) at a right end. Next, the predetermined pattern is arranged so that the upper left corner of the predetermined pattern conforms to a pixel P(2,0) which is below the pixel P(0,0) at the upper left corner by 2 pixels in a downward direction, and a similar process is repeated. Note that the predetermined pattern can be arranged so that the upper left corner of the predetermined pattern conforms to the pixel P(1,1). Subsequently, the process is carried out in a manner similar to that of Embodiment 1. As a result, it is possible to calculate a density Dc in relation to the entire image.

Modification Example 2

In an example illustrated in (b) of FIG. 9, pixels in the same column are driven in the same polarity, and the polarity is reversed for each of the columns. In Modification Example 2, the density Dc is calculated by using, as the predetermined pattern, a pattern including pixels in x-th column in y-th row through (y+2)th row; and pixels in (x+2)th column in y-th row through (y+2)th row.

First, as illustrated in (b) of FIG. 9, the predetermined pattern is arranged so that an upper left corner of the predetermined pattern conforms to a pixel P(0,0) at an upper left corner. Next, pixels Pf having grayscale levels falling within the first range are counted in a region A(0,0) including pixels P(0,0) through P(2,0) and pixels P(0,2) through P(2,2) in the arranged predetermined pattern. In a case where the number of the pixels Pf is equal to or larger than a predetermined number, the density Dc is incremented by 1.

Next, the predetermined pattern is moved in a rightward direction by 2 pixels, and a similar process is carried out. Subsequently, this process is repeated until a right end of the predetermined pattern reaches a pixel P(0,n−1) at a right end. Next, the predetermined pattern is arranged so that the upper left corner of the predetermined pattern conforms to a pixel P(1,0) which is below the pixel P(0,0) at the upper left corner by 1 pixel in a downward direction, and a similar process is repeated. Subsequently, the process is carried out in a manner similar to that of Embodiment 1. As a result, it is possible to calculate a density Dc in relation to the entire image.

Modification Example 3

In an example illustrated in (c) of FIG. 9, a set of two pixels adjacent to each other in the column direction is driven in the same polarity, and adjacent sets are driven in different polarities. In Modification Example 3, the density Dc is calculated by using, as the predetermined pattern, a pattern including pixels in x-th column in y-th row through (y+1)th row; pixels in (x+2)th column in y-th row through (y+1)th row; pixels in (x+1)th column in (y+2)th row through (y+3)th row; and pixels in (x+3)th column in (y+2)th row through (y+3)th row.

First, as illustrated in (c) of FIG. 9, the predetermined pattern is arranged so that an upper left corner of the predetermined pattern conforms to a pixel P(0,0) at an upper left corner. Next, pixels Pf having grayscale levels falling within the first range are counted in a region A(0,0) including pixels P(0,0) through P(1,0), pixels P(0,2) through P(1,2), pixels P(2,1) through P(3,1), and pixels P(2,3) through P(3,3) in the arranged predetermined pattern. In a case where the number of the pixels Pf is equal to or larger than a predetermined number, the density Dc is incremented by 1.

Next, the predetermined pattern is moved in a rightward direction by 2 pixels, and a similar process is carried out. Subsequently, this process is repeated until a right end of the predetermined pattern reaches a pixel P(0,n−1) at a right end. Next, the predetermined pattern is arranged so that the upper left corner of the predetermined pattern conforms to a pixel P(4,0) which is below the pixel P(0,0) at the upper left corner by 4 pixels in a downward direction, and a similar process is repeated. Note that the predetermined pattern can be arranged so that the upper left corner of the predetermined pattern conforms to the pixel P(2,1). Subsequently, the process is carried out in a manner similar to that of Embodiment 1. As a result, it is possible to calculate a density Dc in relation to the entire image.

Embodiment 3

The following description will discuss another embodiment of the present invention. In Embodiment 3, a block configuration of a display device is identical with that of Embodiment 1 but a flow of calculating a density Dc is different from that of Embodiment 1.

(Flow of Calculating Density Dc)

Figure 10:
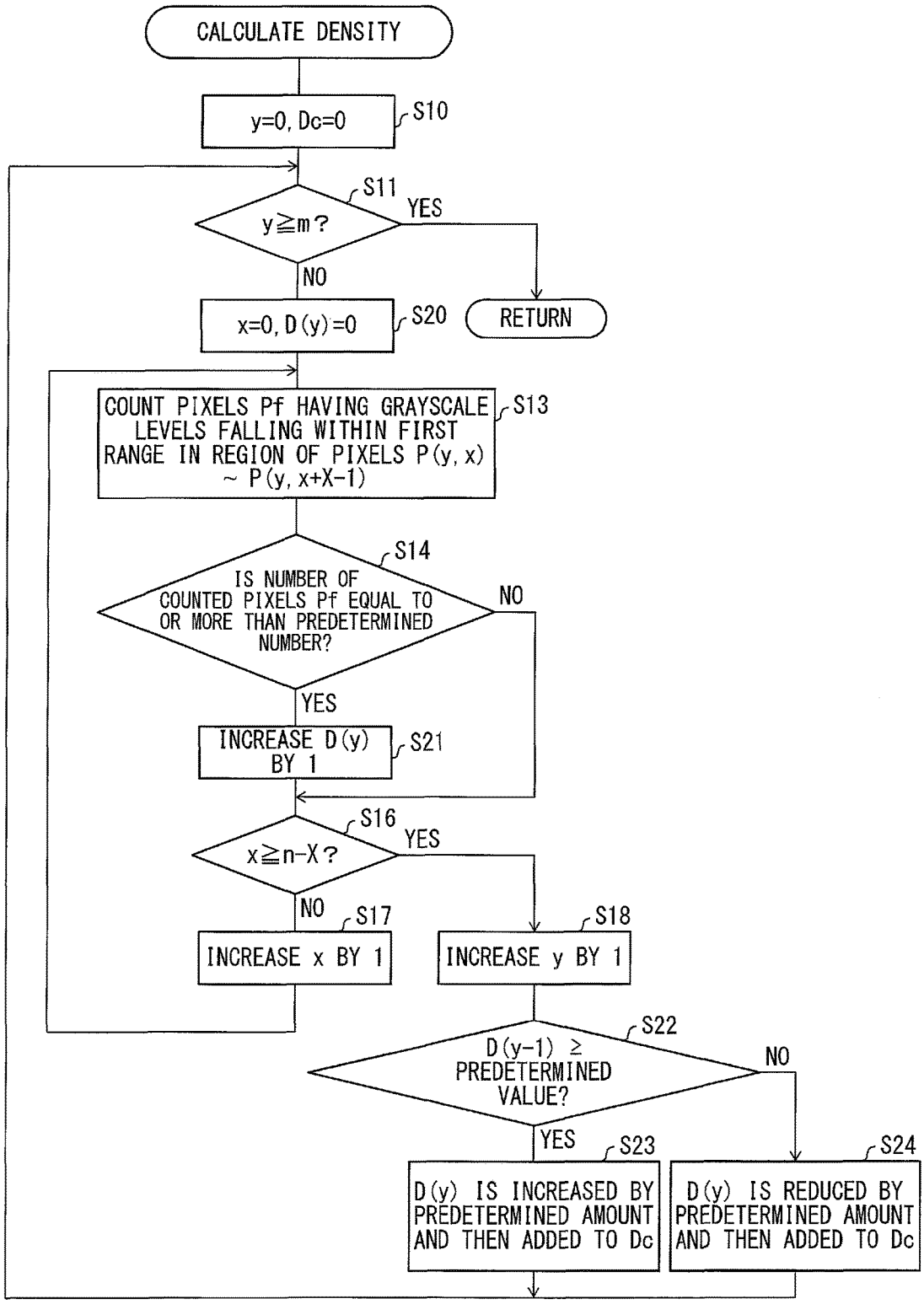
FIG. 10 is a view showing another flow chart of a process in which the host control section calculates a density.

FIG. 10 is a view showing a flow chart of a subroutine for calculating a density. The flow chart shown in FIG. 10 is different from the flow chart shown in FIG. 7 in that steps S20 and S21 are added instead of the steps S12 and S15, and steps S22 through S24 are added after the step S18. The other configurations in the flow chart shown in FIG. 10 are identical with those in the flow chart shown in FIG. 7.

In the step S20, an x-th column is initialized to zero and a density D(y) in a certain row is initialized to zero. Moreover, in a case where the number of counted pixels Pf is equal to or larger than a predetermined number (Yes in S14), the density D(y) in the certain row is incremented by 1 in the step S21.

After the step S18, it is determined whether or not a density D(y−1) in a previous row is equal to or higher than a predetermined value (S22). In a case where the density D(y−1) in the previous row is equal to or higher than the predetermined value (Yes in S22), it is assumed that pixels P having grayscale levels falling within the first range are more likely to extend in the column direction, and the density D(y) in the certain row is increased by a predetermined amount, and the density D(y) thus increased is added to the density Dc (S23). On the other hand, in a case where the density D(y−1) in the previous row is lower than the predetermined value (No in S22), it is assumed that pixels P having grayscale levels falling within the first range are less likely to extend in the column direction, and the density D(y) in the certain row is reduced by a predetermined amount, and the density D(y) thus reduced is added to the density Dc of the image (S24). After that, the process returns to the step S11, and the above operation is repeated. Note that, in a case where y=0, the steps S22 through S24 are not carried out.

According to Embodiment 3, it is possible to calculate the density Dc in the image while reflecting extension, in the column direction, of pixels P having grayscale levels within the first range, even in a case where the predetermined pattern is one (1) row.

Embodiment 4

The following description will discuss still another embodiment of the present invention. For convenience, members similar in function to those described in the foregoing embodiment(s) will be given the same reference signs, and their description will be omitted. In Embodiment 4, an image determining section and a driving changing section for determining a refresh rate are provided on a substrate other than a host control section.

(Configuration of Display Device 2)

Figure 11:
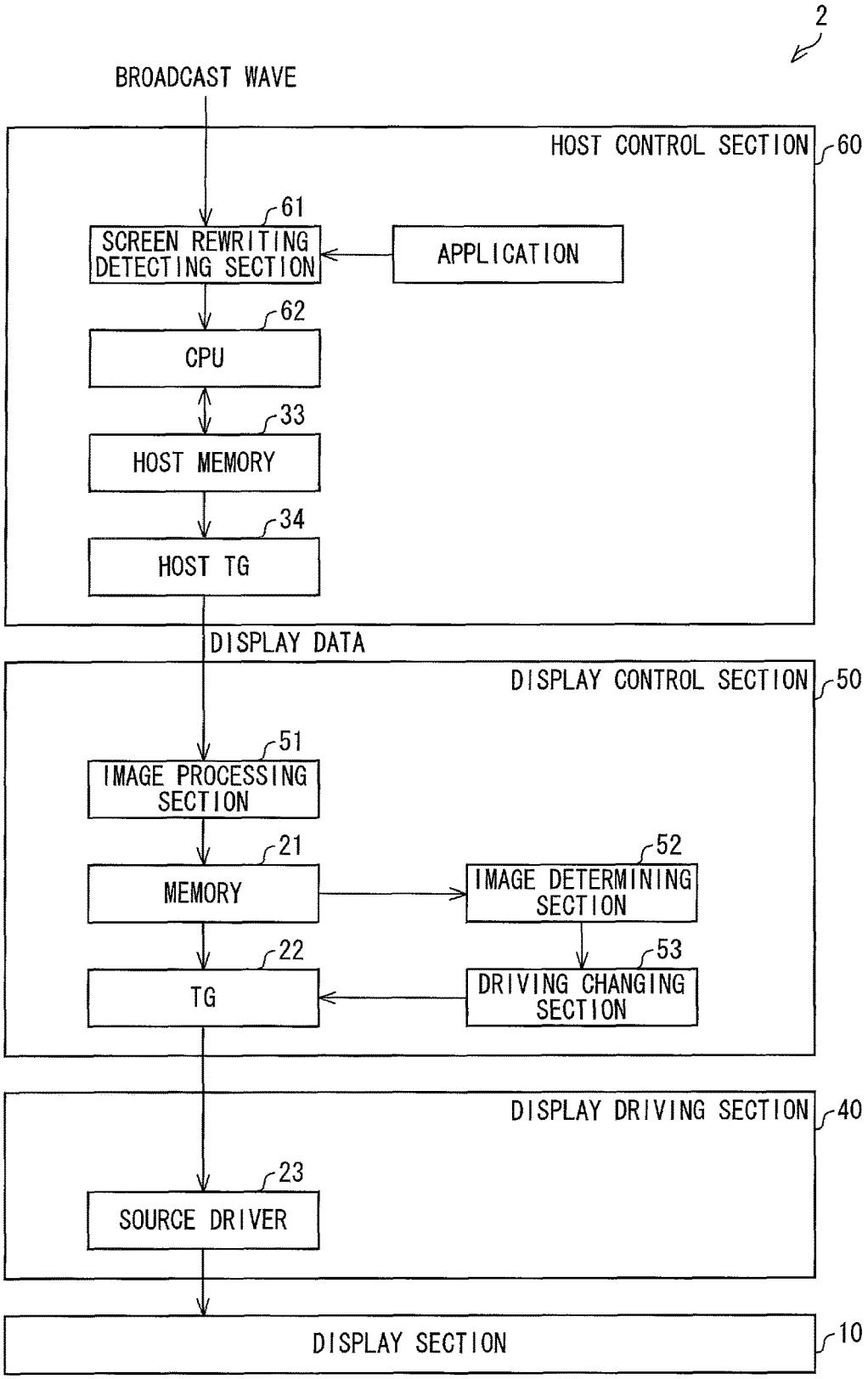
FIG. 11 is a block diagram illustrating a configuration of a display device in accordance with another aspect of the present invention.

FIG. 11 is a block diagram illustrating a configuration of a display device in accordance with Embodiment 4. A display device 2 includes a display section 10, a display driving section 40, a display control section 50 (control device), and a host control section 60.

As with Embodiment 1, the display driving section 40 is a COG driver mounted on a glass substrate of the display section 10 by use of the COG technique, and drives the display section 10. The host control section 60 is configured by a control circuit provided on a substrate, and is a main component for controlling a host side of the display device 2. The display control section 50 is provided on the substrate separately from the host control section 60 for processing a displayed image and the like. According to Embodiment 4, it is the display control section 50 that determines a refresh rate. This allows for a reduction in load of the host control section 60, and therefore makes it possible to secure performance of the host control section 60 for carrying out a process other than displaying an image.

(Configuration of Host Control Section 60)

The host control section 60 includes a screen rewriting detection section 61, a CPU 62, a host memory 33, and a host TG 34.

The screen rewriting detection section 61 may or may not evaluate an interval between points in time at which content of an image is changed and then notify the display control section 50 of the interval. For example, the evaluation of the interval can be carried out on a display-control-section-50 side. Any other process of the screen rewriting detection section 61 is carried out as with the case of the screen rewriting detection section 31 of Embodiment 1.

The CPU 62 carries out processes similar to those carried out by the CPU 32 of Embodiment 1 except that the CPU 62 does not supply display data to an image determining section.

Only in a case where a displayed image needs to be rewritten, the host TG 34 transfers display data on the image to the display control section 50.

(Configuration of Display Control Section 50)

The display control section 50 includes an image processing section 51, an image determining section 52 (calculating section), a driving changing section 53, a memory 21, and a TG 22.

The image processing section 51 subjects, to image processing such as color adjustment, the display data received from the host control section 60. The image processing section 51 then writes, into the memory 21, the display data which has been subjected to the image processing.

When the display data stored in the memory 21 is rewritten, the image determining section 52 obtains the display data from the memory 21. The image determining section 52 determines whether or not an image based on the display data is an image in which flicker easily occurs. The determining process of the image determining section 52 is similar to the process described in the preceding embodiments. The image determining section 52 then supplies a determined result to the driving changing section 53. The image determining section 52 (rewriting detection section) can also (i) evaluate an interval between points in time at which content of the image is changed and (ii) supply data on the interval to the driving changing section 53.

Based on the determined result of the image determining section 52, the driving changing section 53 (i) determines a refresh rate and (ii) notifies the TG 22 of the refresh rate so as to instruct that the display section 10 be driven at the refresh rate thus determined.

In accordance with the refresh rate instructed by the driving changing section 53, the TG 22 (i) reads out the display data from the memory 21 and (ii) transfers the display data to a source driver 23 of the display driving section 40. Note that the TG 22 transfers, in line at the refresh rate, the display data to the display driving section 40 regardless of whether or not an image stored in the memory 21 has been rewritten.

The display driving section 40 includes the source driver 23. A configuration of the source driver 23 is similar to that in Embodiment 1.

Embodiment 5

The following description will discuss still another embodiment of the present invention. For convenience, members similar in function to those described in the foregoing embodiment(s) will be given the same reference signs, and their description will be omitted. According to Embodiment 5, an image determining section and a driving changing section for determining a refresh rate are provided in a display driving section which is a COG driver.

(Configuration of Display Device 3)

Figure 12:
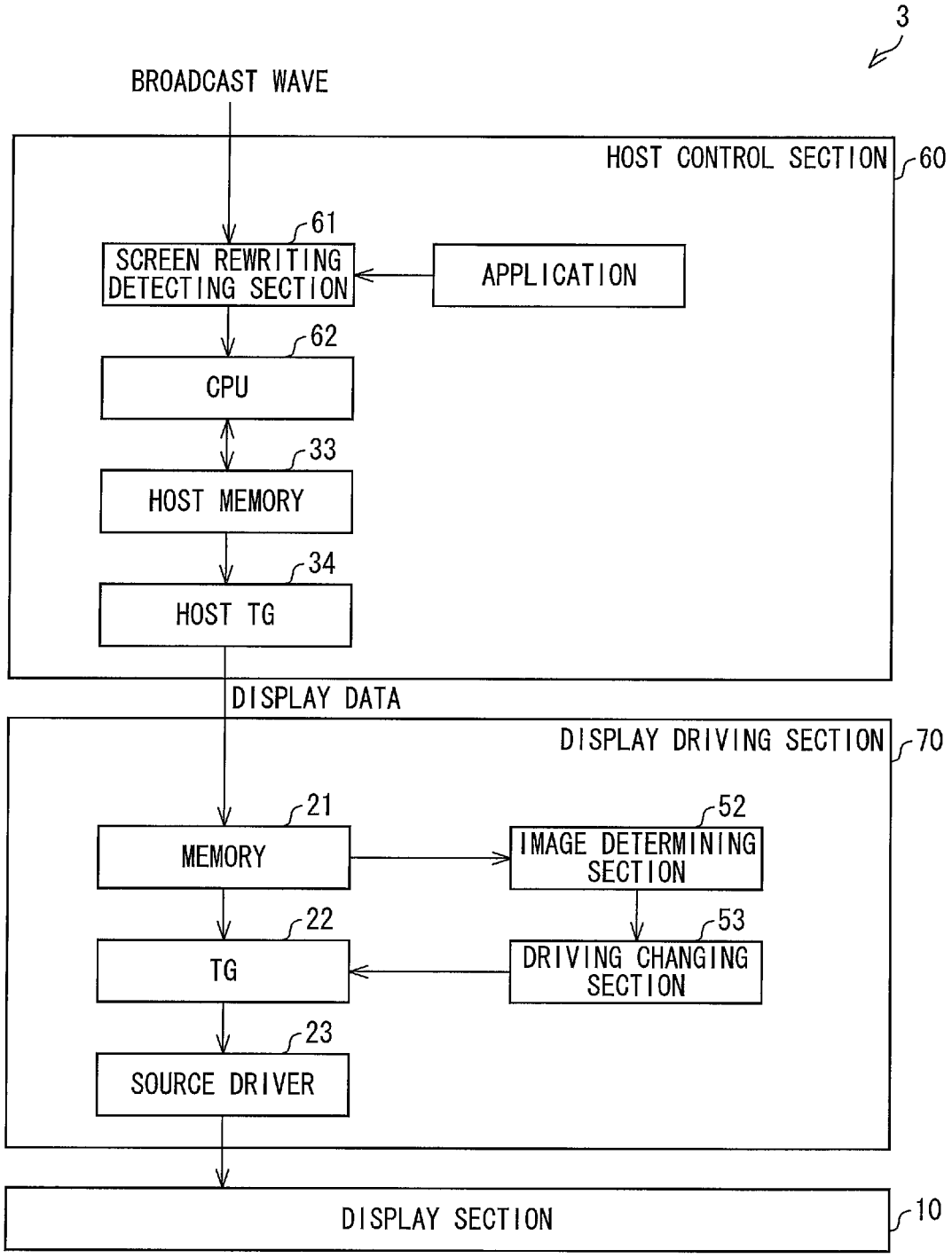
FIG. 12 is a block diagram illustrating a configuration of a display device in accordance with still another aspect of the present invention.

FIG. 12 is a block diagram illustrating a configuration of a display device in accordance with Embodiment 5. A display device 3 includes a display section 10, a display driving section 70 (control device), and a host control section 60. A configuration of the host control section 60 is similar to that in Embodiment 4. Only in a case where a displayed image needs to be rewritten, the host control section 60 transfers display data on the image to the display driving section 70.

The display driving section 70 is a COG driver mounted on a glass substrate of the display section 10 by use of the COG technique, and drives the display section 10. The display driving section 70 includes an image determining section 52, a driving changing section 53, a memory 21, a TG 22, and a source driver 23. Operations of the members included in the display driving section 70 are similar to those described in Embodiment 4.

According to Embodiment 5, it is the COG driver (display driving section 70) that determines a refresh rate. This makes it possible to reduce a load of the host control section 60 without providing a substrate in addition to the host control section 60. Note that a surface area by which COG driver is mounted on an active matrix substrate is limited. Therefore, Embodiment 5 is suitable for a case where the image determining section 52 and the driving changing section 53 carry out only a simple determining process.

(Software Implementation Example)

Control blocks of the display devices 1 through 3 (particularly, the CPUs 32 and 62 and the image determining sections 35 and 52) can be realized by a logic circuit (hardware) provided in an integrated circuit (IC chip) or the like or can be alternatively realized by software as executed by a central processing unit (CPU).

In the latter case, each of the display devices 1 through 3 includes a CPU that executes instructions of a program that is software realizing the foregoing functions; a read only memory (ROM) or a storage device (each referred to as "storage medium") in which the program and various kinds of data are stored so as to be readable by a computer (or a CPU); and a random access memory (RAM) in which the program is loaded. An object of the present invention can be achieved by a computer (or a CPU) reading and executing the program stored in the storage medium. Examples of the storage medium encompass "a non-transitory tangible medium" such as a tape, a disk, a card, a semiconductor memory, and a programmable logic circuit. The program can be supplied to the computer via any transmission medium (such as a communication network or a broadcast wave) which allows the program to be transmitted. Note that the present invention can also be achieved in the form of a computer data signal in which the program is embodied via electronic transmission and which is embedded in a carrier wave.

(Main Points)

A control device (host control section 30, 60, display control section 50, display driving section 20, 40, 70) in accordance with an aspect 1 of the present invention is a control device for controlling a display device (1 through 3) and includes a calculating section (image determining section 35, 52) for calculating a density of pixels, which have grayscale levels falling within a first range, among a plurality of pixels in an image, grayscale levels in the first range being intermediate grayscale levels; and a driving changing section (36, 53) for changing a refresh rate of the display device in accordance with the density which has been calculated by the calculating section.

Here, the density of pixels having grayscale levels falling within the first range represents a degree to which such pixels are gathering in an image, and reflects the number and a size of the gathering pixels.

In general, flicker easily occurs in an image having pixels of intermediate grayscale levels. However, the flicker is hardly recognizable in an image in which pixels of such intermediate grayscale levels are dispersed. On the other hand, in an image in which pixels of intermediate grayscale levels are gathering, the flicker is easily recognizable.

In view of this, according to the configuration, it is possible to determine whether or not flicker is easily recognizable in an image, by calculating a density of pixels having intermediate grayscale levels in the image. Therefore, the control device in accordance with the present aspect can easily determine whether or not flicker is easily recognizable in an image, as compared with Patent Literature 1, because it is not necessary to use an image pattern having a characteristic of easily causing flicker. Moreover, by changing a refresh rate of the display device in accordance with the determined result, it is possible to carry out good display while lowering power consumption and preventing flicker from being recognized.

In the control device in accordance with an aspect 2 of the present invention, it is possible in the aspect 1 that, in a case where a percentage of pixels, which have grayscale levels falling within the first range among pixels included in a predetermined pattern in the image, is equal to or higher than a predetermined percentage, the calculating section increments the density; and the calculating section repeats an above process while moving the predetermined pattern in a row direction and a column direction by a predetermined amount for an entire region in the image, and thus calculates the density.

In the control device in accordance with an aspect 3 of the present invention, it is possible in the aspect 1 that the calculating section calculates a density of pixels, which have grayscale levels falling within the first range, among a plurality of pixels in a certain row in the image; the calculating section increments or decrements the density, which has been calculated, in accordance with a density in a row previous to the certain row and adds the density, which has been incremented or decremented, to a density in the image; and the calculating section repeats above processes for each row in the image, and thus calculates the density in the image.

According to the configuration, even though the density in a row is used, it is possible to calculate the density in the image while reflecting extension, in the column direction, of pixels having grayscale levels in the first range. As a result, it is possible to accurately determine whether or not flicker is easily recognizable in the image.

In the control device in accordance with an aspect 4 of the present invention, it is possible in the aspects 1 through 3 that the display device is a liquid crystal display device which displays an image with a reversal driving method; and the calculating section calculates a density of pixels, which have grayscale levels falling within the first range and are identical in polarity in the reversal driving method, among a plurality of pixels in the image. In this case, it is possible to accurately determine whether or not the image is an image in which flicker is easily recognizable.

In the control device in accordance with an aspect 5 of the present invention, it is possible in the aspects 1 through 4 that, in a case where the density which has been calculated by the calculating section is lower than a first threshold value, the driving changing section determines that display is carried out at a first refresh rate; and, in a case where the density is equal to or higher than the first threshold value, the driving changing section determines that display is carried out at a second refresh rate that is higher than the first refresh rate.

The display device in accordance with an aspect 6 of the present invention includes the control device in accordance with any one of the aspects 1 through 5. In this case, it is possible to bring about an effect similar to those of the aspects 1 through 5.

In the display device in accordance with an aspect 7 of the present invention, an oxide semiconductor can be used as a semiconductor layer of each of TFTs which are included in respective pixels in the display device.

The control method in accordance with an aspect 8 of the present invention is a method for controlling a display device and includes the steps of: calculating a density of pixels, which have grayscale levels falling within a first range, among a plurality of pixels in an image, grayscale levels in the first range being intermediate grayscale levels; and changing a refresh rate of the display device in accordance with the density which has been calculated in the calculating step. In this case, it is possible to bring about an effect similar to that of the aspect 1.

The control device in accordance with each of the aspects of the present invention can be realized by a computer. In such a case, the present invention encompasses (i) a control program of the control device which control program causes the computer to serve as the sections (software elements) of the control device for realizing the control device and (ii) a computer-readable storage medium storing the control program.

The present invention is not limited to the embodiments, but can be altered by a skilled person in the art within the scope of the claims. The present invention also encompasses, in its technical scope, any embodiment derived by combining technical means disclosed in differing embodiments. Further, it is possible to form a new technical feature by combining the technical means disclosed in the respective embodiments.

INDUSTRIAL APPLICABILITY

The present invention is applicable to any display device in which a refresh rate can be changed.

REFERENCE SIGNS LIST

1 through 3: Display device
10: Display section
20, 40, 70: Display driving section (control device)
21: Memory
22: TG
23: Source driver
30, 60: Host control section (control device)
31, 61: Screen rewriting detection section
32, 62: CPU
33: Host memory
35, 52: Image determining section
36, 53: Driving changing section
50: Display control section (control device)
51: Image processing section
52: Image determining section
62: CPU

The invention claimed is:

1. A control device that controls a display device, said control device comprising:

calculating circuitry that calculates a density of pixels, which have grayscale levels falling within a first range, among a plurality of pixels in an image, the grayscale levels in the first range being intermediate grayscale levels; and driving changing circuitry that changes a refresh rate of the display device in accordance with the density of pixels which has been calculated by the calculating circuitry, wherein in a case where a percentage of pixels, which have the grayscale levels falling within the first range among pixels included in a predetermined pattern in the image, is equal to or higher than a predetermined percentage, the calculating circuitry increments the density of pixels, in a case where the percentage of pixels, which have the grayscale levels falling within the first range among pixels included in the predetermined pattern in the image, is less than the predetermined percentage, the calculating circuitry does not increment the density of pixels, and the calculating circuitry respectively increments the density of pixels or does not increment the density of pixels while moving the predetermined pattern in a row direction and a column direction by a predetermined amount for an entire region in the image, and calculates the density of pixels.

2. A control device that controls a display device, the control device comprising:

calculating circuitry that calculates a density of pixels, which have grayscale levels falling within the first range, among a plurality of pixels in a certain row in the image, the grayscale levels in the first range being intermediate grayscale levels; and driving changing circuitry that changes a refresh rate of the display device in accordance with the density of pixels which has been calculated by the calculating circuitry, wherein the calculating circuitry increments or decrements the density of pixels, which has been calculated, in accordance with a density in a row previous to the certain row and adds the density of pixels, which has been incremented or decremented, to a density in the image; and the calculating circuitry respectively increments or decrements the density of pixels for each row in the image, and thus calculates the density in the image.

3. The control device as set forth in claim 1, wherein:

the display device is a liquid crystal display device which displays an image with a reversal driving method; and the calculating circuitry calculates the density of pixels, which have the grayscale levels falling within the first range and are identical in polarity in the reversal driving method, among a plurality of pixels in the image.

4. The control device as set forth in claim 1, wherein:

in a case where the density of pixels which has been calculated by the calculating circuitry is lower than a first threshold value, the driving changing circuitry determines that display is carried out at a first refresh rate; and in a case where the density of pixels is equal to or higher than the first threshold value, the driving changing circuitry determines that display is carried out at a second refresh rate that is higher than the first refresh rate.

5. A display device comprising a control device recited in claim 1.

6. The display device as set forth in claim 5, wherein: an oxide semiconductor is used as a semiconductor layer of each of thin-film transistors (TFTs) which are included in respective pixels in the display device.

7. A non-transitory computer-readable recording medium in which a control program causes a computer to function as the control device recited in claim 1, wherein the control program causes the computer to function as the calculating circuitry and the driving changing circuitry.

8. A method that controls a display device, said method comprising:

calculating a density of pixels, which have grayscale levels falling within a first range, among a plurality of pixels in an image, the grayscale levels in the first range being intermediate grayscale levels; and changing a refresh rate of the display device in accordance with the density of pixels which has been calculated in the calculating step, wherein in a case where a percentage of pixels, which have the grayscale levels falling within the first range among pixels included in a predetermined pattern in the image, is equal to or higher than a predetermined percentage, the calculating step increments the density of pixels, in a case where the percentage of pixels, which have the grayscale levels falling within the first range among pixels included in the predetermined pattern in the image, is less than the predetermined percentage, the calculating step does not increment the density of pixels, and the calculating step respectively increments the density of pixels or does not increment the density of pixels while moving the predetermined pattern in a row direction and a column direction by a predetermined amount for an entire region in the image, and calculates the density of pixels.

9. The control device as set forth in claim 2, wherein:

the display device is a liquid crystal display device which displays an image with a reversal driving method; and the calculating circuitry calculates the density of pixels, which have the grayscale levels falling within the first range and are identical in polarity in the reversal driving method, among a plurality of pixels in the image.

10. The control device as set forth in claim 2, wherein:

in a case where the density of pixels which has been calculated by the calculating circuitry is lower than a first threshold value, the driving changing circuitry determines that display is carried out at a first refresh rate, and in a case where the density of pixels is equal to or higher than the first threshold value, the driving changing circuitry determines that display is carried out at a second refresh rate that is higher than the first refresh rate.

11. A display device comprising a control device recited in claim 2.

12. The display device as set forth in claim 11, wherein an oxide semiconductor is used as a semiconductor layer of each of thin-film transistors included in respective pixels in the display device.

13. A non-transitory computer-readable recording medium in which a control program causes a computer to function as the control device recited in claim 2, wherein the control program causes the computer to function as the calculating circuitry and the driving changing circuitry.

14. A method that controls a display device, the method comprising:

calculating a density of pixels, which have grayscale levels falling within a first range, among a plurality of pixels in an image, the grayscale levels in the first range being intermediate grayscale levels; and changing a refresh rate of the display device in accordance with the density of pixels which has been calculated in the calculating step; wherein the calculating calculates the density of pixels, which have the grayscale levels falling within the first range, among a plurality of pixels in a certain row in the image;

the calculating increments or decrements the density of pixels, which has been calculated, in accordance with a density in a row previous to the certain row and adds the density, which has been incremented or decremented, to a density in the image, and the calculating respectively increments or decrements the density of pixels for each row in the image, and calculates the density in the image.

* * * * *